US008337670B2

(12) United States Patent
Oouchi

(10) Patent No.: US 8,337,670 B2
(45) Date of Patent: Dec. 25, 2012

(54) FELT FOR PAPERMAKING

(75) Inventor: Takashi Oouchi, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 747 days.

(21) Appl. No.: 12/307,188

(22) PCT Filed: Jul. 5, 2007

(86) PCT No.: PCT/JP2007/063454

§ 371 (c)(1),
(2), (4) Date: Sep. 15, 2009

(87) PCT Pub. No.: WO2008/004618

PCT Pub. Date: Jan. 10, 2008

(65) Prior Publication Data

US 2010/0018663 A1 Jan. 28, 2010

(30) Foreign Application Priority Data

Jul. 6, 2006 (JP) ..... 2006-186295

(51) Int. Cl.
*D21F 7/08* (2006.01)

(52) U.S. Cl. ..... 162/358.2; 162/900

(58) Field of Classification Search ..... 162/358.1, 162/358.2, 358.4, 306, 900, 902–904; 442/271, 442/275, 277, 281
See application file for complete search history.

(56) References Cited

U.S. PATENT DOCUMENTS 4,267,227 A * 5/1981 Schiher et al. ..... 442/275
4,500,588 A 2/1985 Lundstrom
4,529,643 A 7/1985 Lundström ..... 428/234
5,207,873 A * 5/1993 Sanduja et al. ..... 162/358.2
2004/0200594 A1 * 10/2004 Ouchi et al. ..... 162/358.2

FOREIGN PATENT DOCUMENTS

EP 0279089 * 8/1988
JP 63-259000 10/1988
JP 6-65886 3/1994
JP 2006-97181 A1 4/2006

OTHER PUBLICATIONS

International Search Report for International Application PCT/JP2007/063454 dated Sep. 25, 2007.
Extended European Search Report issued in counterpart application mailed May 9, 2012 (5 pages).

* cited by examiner

*Primary Examiner* — Eric Hug
(74) *Attorney, Agent, or Firm* — Kratz, Quintos & Hanson, LLP

(57) ABSTRACT

A felt (10) for papermaking according to the present invention has a batt fiber layer comprising batt fibers contained in and integrally combined with a high-polymer elastic material (50). The batt fiber layer contained in the high-polymer elastic material (50) includes hydrophilic 1-methyl-2-pyrrolidone. The felt (10) for papermaking exhibits a hydrophilic capability as a felt structure from an initial phase of use. The felt has a sustained ability to be compressed and recovered for a long period of time and maintains water squeezing function, a wet paper web smoothing function, and a wet paper web feeding function until the end of the period in which the felt is used.

3 Claims, 4 Drawing Sheets

FELT FOR PAPERMAKING

TECHNICAL FIELD

The present invention relates to a felt for papermaking (hereinafter referred to as "felt") for use in a papermaking machine.

BACKGROUND ART

Papermaking machines generally have three zones, i.e., a forming zone, a pressing zone and a drying zone, for removing water from the web material during the papermaking process. In each of the zones, water is continuously removed from the wet paper web. Each of the zones employs a papermaking tool having a dehydrating capability.

The pressing zone employs a felt as such a papermaking tool, which runs in the warpwise direction (MD). Specifically, the pressing zone includes a pressurizing mechanism for transferring water from wet paper web to the felt to dehydrate the wet paper web while the felt and the wet paper web are traveling through the pressurizing mechanism.

The pressurizing mechanism generally comprises a pair of pressing rolls or comprises a pressing roll and a shoe shaped complementarily to a circumferential surface of the pressing roll.

The structure of the felt will be described below with reference to FIG. 1. FIG. 1 is a cross-sectional view showing a general structural arrangement of a felt 100 for papermaking according to the background art.

The felt 100 for papermaking comprises a base 20, face-side batt fibers 31 stacked on the base 20, and reverse-side batt fibers 32 stacked on the base 20. The batt fibers 31, 32 are implanted on the base 20 by needle punching or the like. The base 20 usually comprises a woven fabric formed of warp yarns 21 and weft yarns 22 by weaving.

The felt has a plurality of basic functions including a water squeezing function to squeeze water out of the wet paper web, a smoothing function to increase the smoothness of the wet paper web, and a wet paper web feeding function to feed the wet paper web.

Of these felt functions, the function to squeeze water out of the wet paper web (water squeezing function) is regarded as important. According to the function to squeeze water out of the wet paper web, water is transferred from the wet paper web to the felt under pressure while the wet paper web and the felt are traveling through between a pair of pressing rolls.

The transferred water in the felt is discharged from the reverse side of the felt under pressure or is drawn out of the felt by a suction box of the papermaking machine. Therefore, it is important that the felt should have a sustained ability to be compressed when pressurized and to be recovered when depressurized, and should also be permeable to water.

Recent trends in the papermaking technology are toward higher-speed papermaking machines for increased productivity and are toward pressing zones having rolls or shoe presses capable of higher pressurization. Therefore, the felt in the pressing zone tends to be flattened under high pressure, and to be lowering its water permeability and its ability to be compressed and recovered. As a result, the water squeezing ability of the felt is greatly reduced.

One solution to the above problems is to contain a high-polymer elastic material in a fiber layer of the felt.

For example, there is known a felt made of fibers impregnated with an emulsion resin and having a wet paper web side processed (see U.S. Pat. No. 4,500,588).

Specifically, the known felt has a batt fiber layer, on a surface of a base layer, which is impregnated with an emulsion resin. The batt fiber layer has a wet paper web side surface which is calendered into a dense and chamois-like surface. In this manner, a barrier layer is produced or a coarse fiber layer on the surface of the base layer is impregnated with an emulsion resin.

A barrier layer (nonwoven layer) is disposed on the coarse fiber layer, and a fine fiber layer is disposed on the barrier layer (nonwoven layer). The barrier layer prevents the emulsion resin from penetrating to the wet paper web side surface of the felt. As a result, the felt is prevented from becoming damp again and also from blowing for an increased papermaking rate.

The fiber layer which is contained in the high-polymer elastic material is less hydrophilic in an initial phase of use. Therefore, the felt contained in the high-polymer elastic material has a strong tendency to repel water when it is first installed in the papermaking machine.

Even if the felt is initially used while a shower of water is being sprinkled over the felt, no sufficient water penetrates the felt. Accordingly the papermaking machine needs to operate at a low rate during a certain period until the felt becomes sufficiently hydrophilic.

Patent document: U.S. Pat. No. 4,500,588

The present invention has been made in efforts to solve the above problems. It is an object of the present invention to provide a felt for papermaking which comprises batt fibers contained in and integrally combined with a high-polymer elastic material making up a batt fiber layer, which allows sufficient water to penetrate the felt from an initial phase of use immediately after the felt is installed in a papermaking machine because the high-polymer elastic material is highly hydrophilic in the initial phase of use.

Another object of the present invention is to provide a felt for papermaking which has a sustained ability to be compressed and recovered for a long period of time from an initial phase of use of the felt and which maintains a water squeezing function, a wet paper web smoothing function, and a wet paper web feeding function until the end of the period in which the felt is used.

DISCLOSURE OF THE INVENTION

A felt for papermaking according to the present invention comprises a base and a batt fiber layer. The batt fiber layer comprises batt fibers contained in and integrally combined with a high-polymer elastic material. The batt fiber layer contained in the high-polymer elastic material includes 1-methyl-2-pyrrolidone.

Preferably, the high-polymer elastic material comprises an emulsion resin including one or more of an urethane emulsion, a vinyl acetate emulsion, a styrene-butadiene emulsion and an acrylic emulsion.

Preferably, the batt fibers contain 20 g/m$^2$ to 150 g/m$^2$ of the high-polymer elastic material.

Preferably, the batt fiber layer contained in the high-polymer elastic material includes 5 g/m$^2$ to 100 g/m$^2$ of the 1-methyl-2-pyrrolidone.

According to the present invention, the batt fibers of the felt for papermaking contain and are integrally combined with the high-polymer elastic material, making up the batt fiber layer. Therefore, the felt exhibits an excellent sustained ability to be compressed and recovered based on the pressure resisting effect of the high-polymer elastic material even if the felt is repeatedly compressed under the pressure of a press.

BEST MODE FOR CARRYING OUT THE INVENTION

Felts for papermaking according to embodiments of the present invention will be described below. The present invention is not limited to the embodiments.

Figure 1:
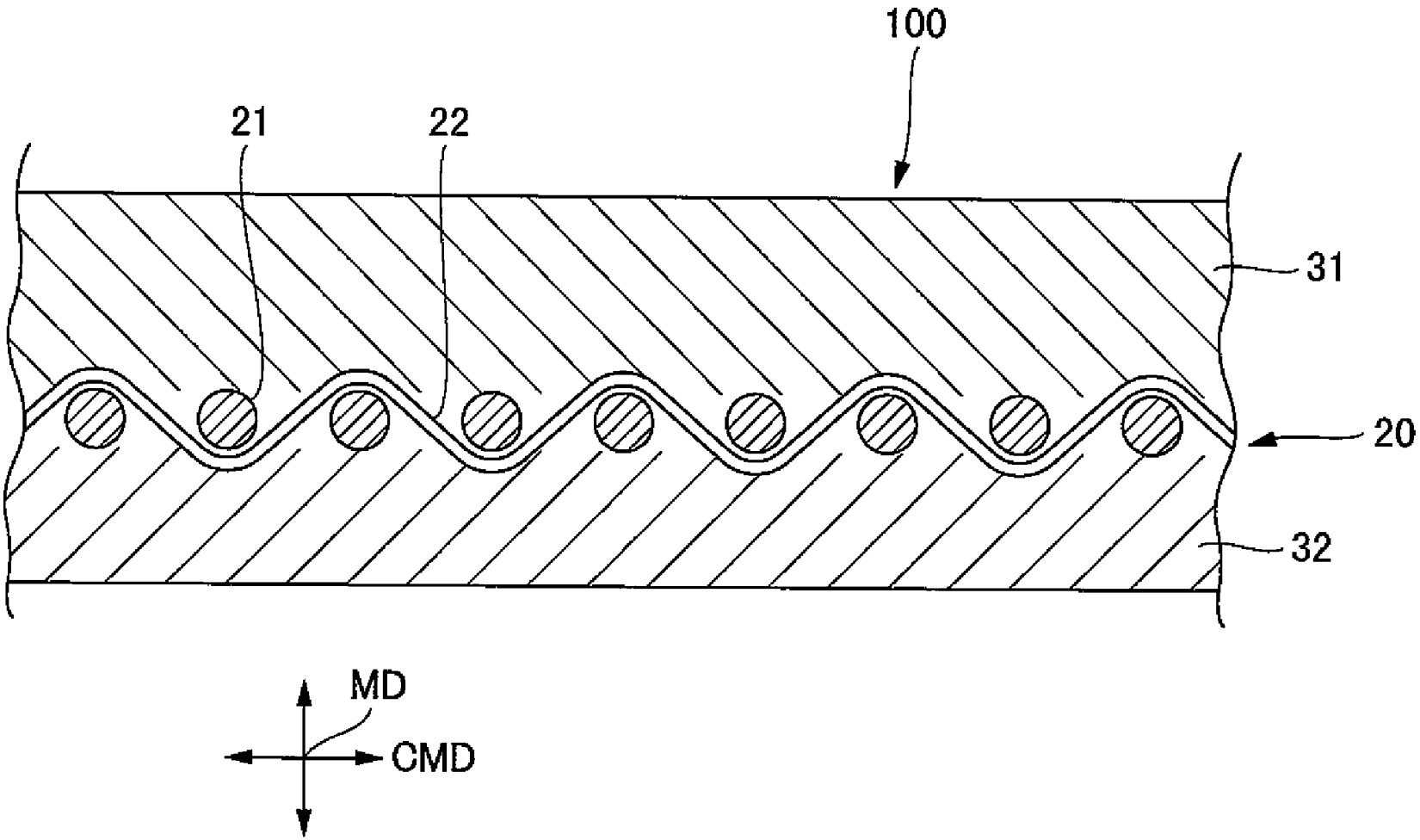
FIG. 1 is a cross-sectional view showing a general structural arrangement of a felt for papermaking according to the background art.
Figure 2:
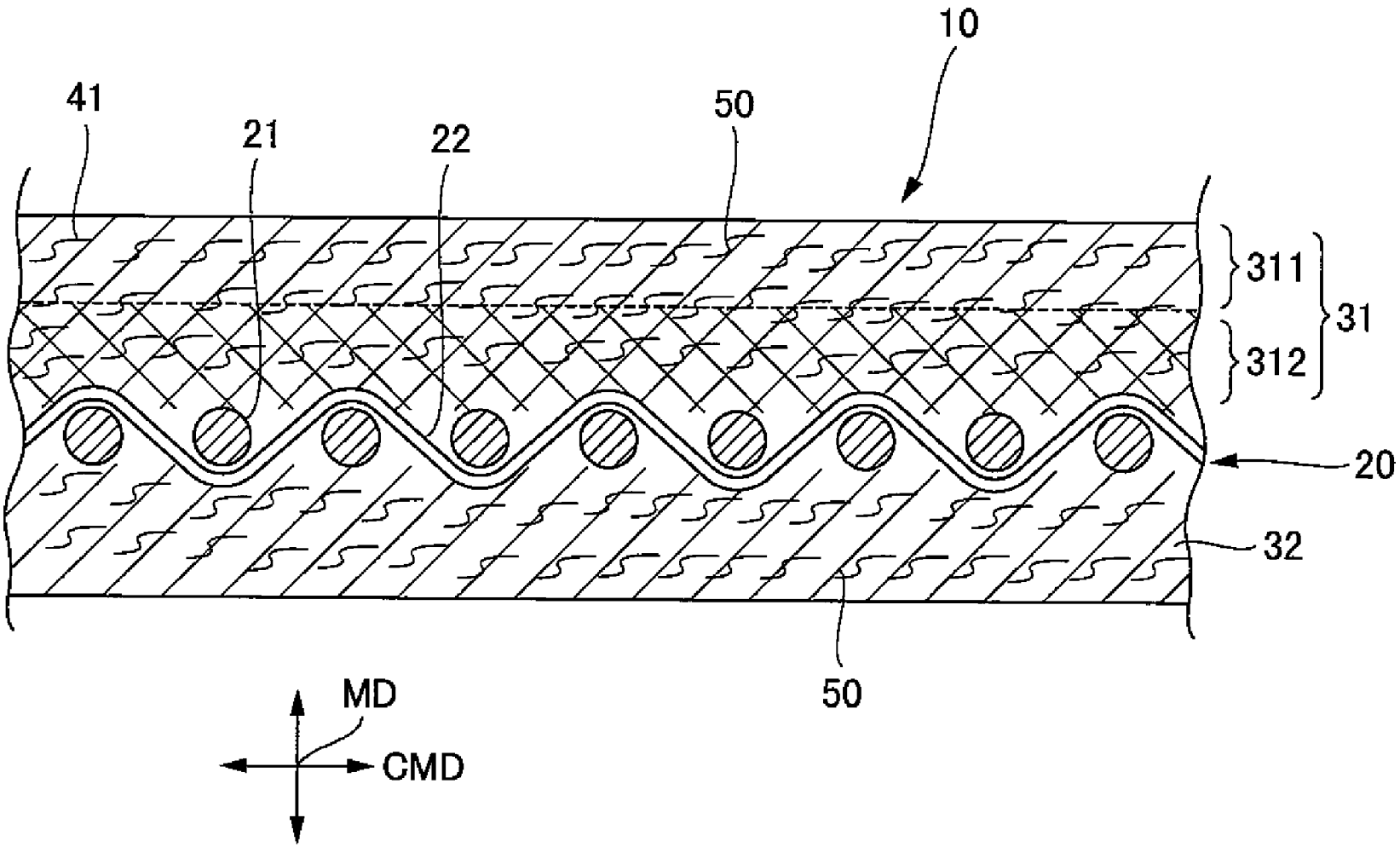
FIG. 2 is a cross-sectional view showing a general structural arrangement of a felt for papermaking according to an embodiment of the present invention.

FIG. 2 is a cross-sectional view of a felt for papermaking according to an embodiment of the present invention, taken along the weftwise direction (CMD direction: the transverse direction of the felt). As shown in FIG. 2, the felt 10 for papermaking comprises a base 20 and a batt fiber layer which are integrally intertwined by needling, and the felt 10 runs in the warpwise direction (MD direction).

The base 20 usually comprises a woven fabric formed of warp yarns 21 and weft yarns 22 on a loom. The warp yarns 21 and the weft yarns 22 comprise monofilaments and multifilaments of nylon, polyester, olefin, or the like. The woven fabric is of a single-ply structure or a multiple-ply structure such as a double-ply structure or a triple-ply structure.

Alternatively, the base 20 may comprise a base made of warp yarns and weft yarns bonded together by an adhesive without being woven, or may comprise a base in the form of a non-woven fabric, a film, or a molded resin, rather than the woven fabric.

Batt fibers in the felt 10 are contained in and integrally combined with a high-polymer elastic material 50 so that a batt fiber layer is made up. The batt fiber layer which is contained in the high-polymer elastic material 50 includes hydrophilic 1-methyl-2-pyrrolidone.

Even if the felt 10 is repeatedly compressed under the pressure of a press, the high-polymer elastic material 10 exhibits a pressure resisting effect. As a result, the felt 10 has an excellent sustained ability to be compressed and recovered.

The batt fibers comprise staple fibers 41. The batt fibers comprise short synthetic fibers such as nylon fibers or short natural fibers such as wool fibers stacked into a web. The batt fibers may comprise blended fibers of different thicknesses and materials.

The batt fibers include face-side batt fibers 31 positioned closely to a wet paper web and reverse-side batt fibers 32 positioned closely to a pressing roll or a shoe of the papermaking machine. The face-side batt fibers 31 are made up of an outermost layer of batt fibers 311 and an inner layer of batt fibers 312.

The batt fibers may comprise the face-side batt fibers 31 only. The batt fibers 311 of the outermost layer should preferably comprise thin fibers to make the surface of the felt 10 dense and smooth. The batt fibers 312 of the inner layer and the reverse-side batt fibers 32 may comprise thick fibers for increased water permeability.

Figure 3:
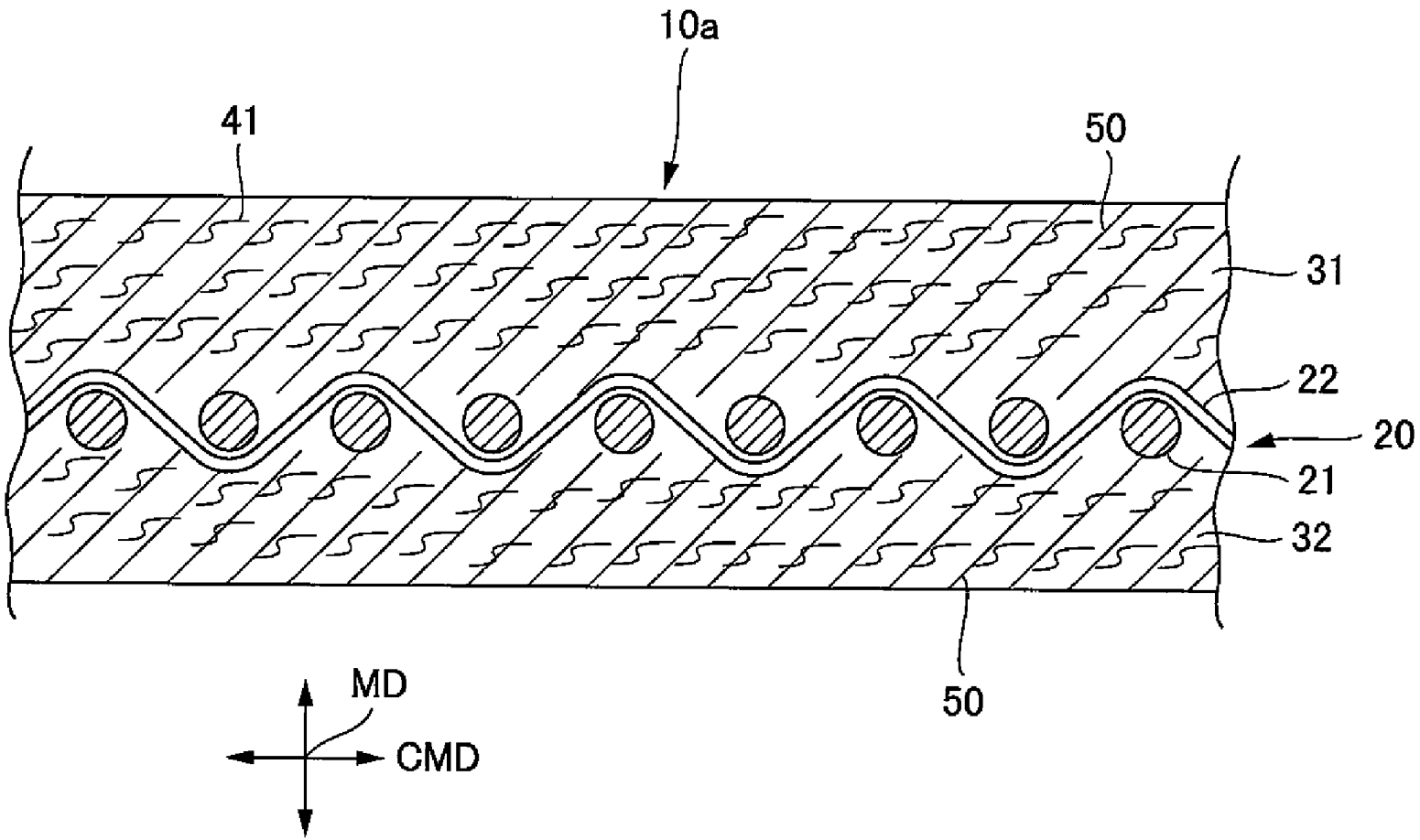
FIG. 3 is a cross-sectional view showing a general structural arrangement of a felt for papermaking according to another embodiment of the present invention.

FIG. 3 is a cross-sectional view of a felt 10*a* for papermaking according to another embodiment of the present invention.

In the felt 10*a* shown in FIG. 3, batt fibers (either one or both of face-side batt fibers 31 and reverse-side batt fibers 32) which comprise staple fibers 41 are contained in and integrally combined with a high-polymer elastic material 50, so that a batt fiber layer is made up.

The batt fiber layer which is contained in the high-polymer elastic material 50 includes hydrophilic 1-methyl-2-pyrrolidone (not shown). Specifically, the batt fiber layer (the batt fibers and the high-polymer elastic material 50) is impregnated with hydrophilic 1-methyl-2-pyrrolidone, jointly making up the batt fiber layer.

With the felts 10, 10*a* shown in FIGS. 2 and 3, the batt fibers are contained in and integrally combined with the high-polymer elastic material 50, so that the batt fiber layer is made up.

Even if the felts 10, 10*a* are repeatedly compressed under the pressure of a press, the elastically deformable high-polymer elastic material 50 in the batt fiber layer exhibits a pressure resisting effect. Therefore, interstices in the batt fiber layer remain uncrushed. As a result, the water permeability of the felts 10, 10*a* and the ability thereof to be compressed and recovered are not lowered.

The batt fiber layer which is contained in the high-polymer elastic material 50 is impregnated with and includes hydrophilic 1-methyl-2-pyrrolidone. Therefore, sufficient water penetrates the felts 10, 10*a* from an initial phase of use immediately after the felts 10, 10*a* are installed in a papermaking machine.

The felts 10, 10*a* has a sustained ability to be compressed and recovered for a long period of time from the initial phase of use. The felts 10, 10*a* maintain a water squeezing function, a wet paper web smoothing function, and a wet paper web feeding function until the end of the period in which the felts 10, 10*a* are used.

If the batt fibers are not contained in the high-polymer elastic material 50, then the felt is greatly deformed when repeatedly compressed. As a consequence, the felt fails to maintain the water squeezing function, the wet paper web smoothing function, and the wet paper web feeding function.

If the batt fiber layer which is contained in the high-polymer elastic material 50 does not include hydrophilic 1-methyl-2-pyrrolidone, then the batt fiber layer is less hydrophilic in the initial phase of use of the felt.

As a result, water finds it difficult to penetrate the felt from the initial phase of use immediately after the felt is installed in a papermaking machine. It takes a long period of time until the felt is sufficiently wetted with water. During that time, the papermaking machine needs to operate at a low rate.

The high-polymer elastic material 50 in the felts 10, 10*a* according to the present invention comprise an emulsion resin including one or more of an urethane emulsion, a vinyl acetate emulsion, an styrene-butadiene emulsion, and an acrylic emulsion.

When water in the emulsion resin is evaporated, the solid matter of the high-polymer elastic material 50 can contain the batt fibers. For stabilizing the emulsion resin, a surfactant or a viscosity modifier should preferably be added to the emulsion resin.

If a surfactant is added to the emulsion resin for stabilizing the emulsion resin, the batt fiber layer contained in the high-polymer elastic material 50 is not made hydrophilic. The reasons are that sufficient water does not penetrate the felts 10, 10*a* from the initial phase immediately after the felts 10, 10*a* are installed in the papermaking machine, regardless of the type of the surfactant (the type based on HLB indicative of the degree to which it is hydrophilic) and the amount used of the surfactant.

According to the present invention, since hydrophilic 1-methyl-2-pyrrolidone has its molecular weight and viscosity much lower than the surfactant, it produces much greater power to cause water to penetrate the felts 10, 10*a*.

The batt fibers should preferably contain 20 g/cm$^2$ to 150 g/cm$^2$ of the high-polymer elastic material 50.

The reasons are as follows: If the amount of high-polymer elastic material 50 is smaller than the above range (20 g/cm$^2$ to 150 g/cm$^2$), then the felts 10, 10*a* fails to sustain its ability to be compressed and recovered. As a result, the felts 10, 10*a* fails to maintain the water squeezing function, the wet paper web smoothing function, and the wet paper web feeding function. If the amount of high-polymer elastic material 50 is greater than the above range, then the water permeability of the felts is lowered, adversely affecting the water squeezing function thereof.

Preferably the batt fiber layer contained in the high-polymer elastic material 50 should include 5 g/m$^2$ to 100 g/m$^2$ of hydrophilic 1-methyl-2-pyrrolidone.

EXAMPLES

The following experiment was conducted in order to confirm the advantages of the felt for papermaking according to the present invention:

For experimentation under common conditions, all felts according to Inventive examples 1 through 6 and Comparative examples 1 through 3 had the following basic configuration:

Base (a plain weave of twisted nylon monofilaments): basis weight of 750 g/m$^2$;

Batt fibers [Short fibers of nylon 6 (staple fibers of 17 dtex)]: basis weight of 500 g/m$^2$ for the face-side batt fibers of the base, and basis weight of 250 g/m$^2$ for the reverse-side batt fibers of the base; and Total basis weight of the felt: 1,500 g/m$^2$.

First, the reverse batt fibers and the face-side batt fibers were stacked on the base and were intertwined therewith by needling, producing the felt. Thereafter, the surface layer of the felt was coated with an aqueous dilute solution prepared by mixing a high-polymer elastic material and 1-methyl-2-pyrrolidone shown in Table 1. The felt was dried at 105° C. In this manner, felts according to Inventive examples 1 through 6 and Comparative examples 1 through 3 were completed.

TABLE 1

| | TYPE OF HIGH-POLYMER ELASTIC MATERIAL | AMOUNT OF HIGH-POLYMER ELASTIC MATERIAL CONTAINED IN BATT FIBER LAYER | AMOUNT OF 1-METHYL-2-PYRROLIDONE CONTAINED IN BATT FIBER LAYER |
|---|---|---|---|
| INVENTIVE EXAMPLE 1 | URETHANE EMULSION | 20 g/m$^2$ | 5 g/m$^2$ |
| INVENTIVE EXAMPLE 2 | URETHANE EMULSION | 100 g/m$^2$ | 30 g/m$^2$ |
| INVENTIVE EXAMPLE 3 | URETHANE EMULSION | 150 g/m$^2$ | 70 g/m$^2$ |
| INVENTIVE EXAMPLE 4 | URETHANE EMULSION | 100 g/m$^2$ | 100 g/m$^2$ |
| INVENTIVE EXAMPLE 5 | URETHANE EMULSION | 50 g/m$^2$ | 30 g/m$^2$ |
| INVENTIVE EXAMPLE 6 | URETHANE EMULSION | 50 g/m$^2$ | 30 g/m$^2$ |
| COMPARATIVE EXAMPLE 1 | URETHANE EMULSION | 10 g/m$^2$ | NONE |
| COMPARATIVE EXAMPLE 2 | NONE | NONE | 10 g/m$^2$ |
| COMPARATIVE EXAMPLE 3 | NONE | NONE | NONE |

URETHANE EMULSION: "SUPERFLEX" BY DAI-ICHI KOGYO SEIYAKU Co., Ltd.

The reasons are as follows: If the amount of hydrophilic 1-methyl-2-pyrrolidone is smaller than the above range (5 g/m$^2$ to 100 g/m$^2$), then water does not penetrate the felt and it takes a long period of time until the felt is sufficiently wetted with water. If the amount of hydrophilic 1-methyl-2-pyrrolidone is greater than the above range, the high-polymer elastic material 50 is denatured. As a consequence, the joining force with which the high-polymer elastic material 50 contains the batt fibers therein is lowered, making the felt unable to sustain the ability to be compressed and recovered.

With the felts 10, 10*a*, the batt fibers contain and are integrally combined with the high-polymer elastic material 50. According to the present arrangement, the batt fibers are implanted on the base 20 by needle punching, thereby forming the felt. Thereafter, the felt is coated with an aqueous dilute solution of emulsion resin, and is dried into an integral structure.

There are two processes available for including hydrophilic 1-methyl-2-pyrrolidone in the batt fiber layer contained in the high-polymer elastic material 50. According to one of the processes, a given amount of 1-methyl-2-pyrrolidone is mixed with an aqueous dilute solution of emulsion resin. According to the other process, the felt is coated with an aqueous dilute solution of emulsion resin, and thereafter is coated with a given amount of 1-methyl-2-pyrrolidone.

Figure 4:
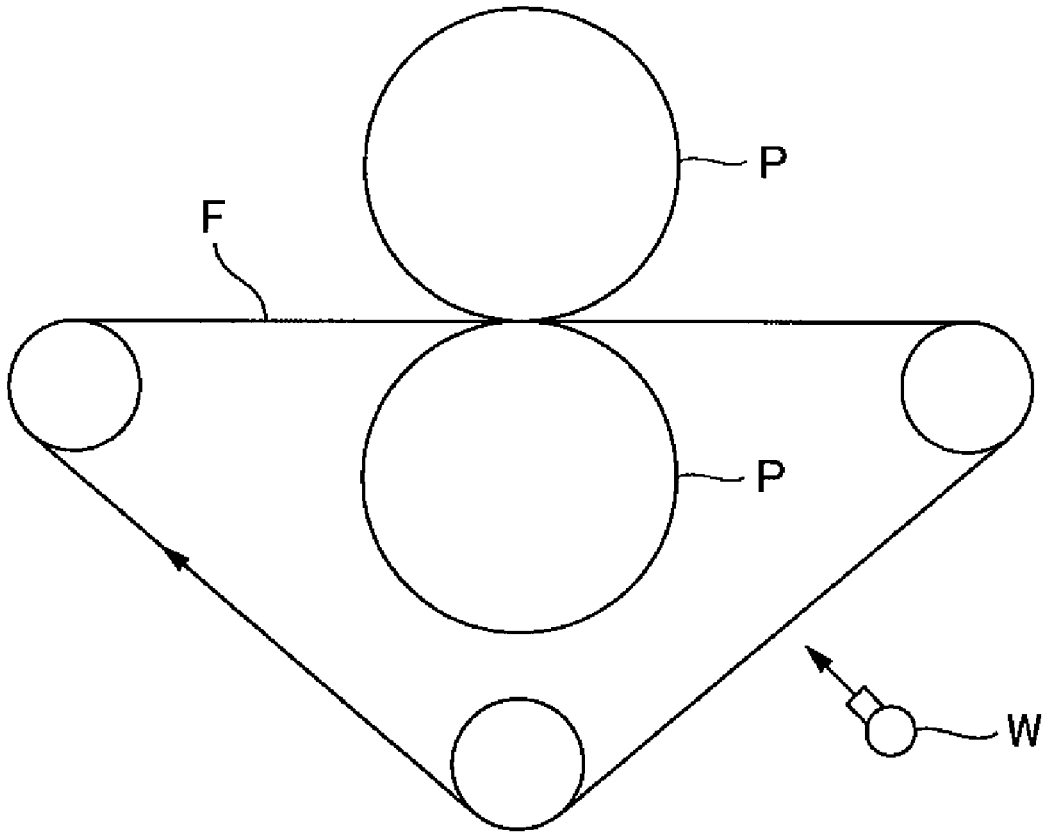
FIG. 4 is a schematic view of an experimental apparatus according to the present invention.

An experimental apparatus shown in FIG. 4 has a pair of pressing rolls P between which a felt F for papermaking travels. The felt F is held under a constant tension. While the felt F is being in rotation, it is repeatedly pressed by the pair of pressing rolls P.

The experimental apparatus shown in FIG. 4 was used to compare the abilities to be compressed and recovered of the felts according to the inventive and comparative examples and their abilities to sustain those abilities, and the times consumed until water penetrated the felts.

The experimental apparatus was operated under such conditions that the felts were pressed under the pressure of 100 kg/cm and were driven at the speed of 1,000 m/min continuously for 120 hours. In the experimental apparatus, the felt F was pressed by the pair of pressing rolls P. The pressing pressure [kg/cm] is a linear pressure per 1 cm in the transverse direction (CMD direction) of the nipped region pressed by the pair of pressing rolls P.

The times were measured as numerical values immediately after the experiment started and numerical values when the experiment ended. The thickness (pressurized thickness) of the felt F was determined when the felt F, which had been immersed in water for 1 hour, was pressed under a constant pressure (30 kg/cm$^2$). Compression ratios and recovery ratios were calculated from the pressurized thickness according to the following equations:

Compression ratio (%)=100×(thickness prior to being pressurized−pressurized thickness)/(thickness prior to being pressurized)

Recovery ratio (%)=100×(thickness subsequent to being depressurized−pressurized thickness)/(pressurized thickness)

The felt F was installed in the experimental apparatus shown in FIG. 4, and a shower W of water was applied to the surface of the felt F. The time consumed until the water uniformly penetrated the felt in its entirety was measured to determine the time consumed until the water fully penetrated the felt. The water permeability of the felt was evaluated with respect to the time, regarded as 100, of the brand-new felt according to Comparative Example 3.

The water permeability is calculated as follows:

[(The time consumed until the water fully penetrated the felt)/(the time consumed until the water fully penetrated the felt according to Comparative Example 3)×100]

The results of the experiment are shown in Table 2. As can be understood from Table 2, the felts according to the inventive examples were confirmed as being able to maintain, at high levels, an ability to be compressed and recovered and an ability to sustain the ability to be compressed and recovered. It was also confirmed that since water penetrates the felts according to the inventive examples in short periods of time, the felts have an ability to squeeze water out of the wet paper web and an ability to sustain the ability to squeeze water out of the wet paper web, and the felts are wetted with water quickly.

TABLE 2

| | COMPRESSION RATIO (%) | | RECOVERY RATIO (%) | | WETTABILITY WATER |
|---|---|---|---|---|---|
| | START | END | START | END | PERMEABILITY |
| INVENTIVE EXAMPLE 1 | 55 | 55 | 57 | 52 | 20 |
| INVENTIVE EXAMPLE 2 | 53 | 53 | 54 | 52 | 30 |
| INVENTIVE EXAMPLE 3 | 50 | 50 | 52 | 52 | 50 |
| INVENTIVE EXAMPLE 4 | 48 | 48 | 51 | 51 | 70 |
| INVENTIVE EXAMPLE 5 | 53 | 53 | 54 | 52 | 100 |
| INVENTIVE EXAMPLE 6 | 53 | 53 | 54 | 52 | 10 OR LOWER |
| COMPARATIVE EXAMPLE 1 | 58 | 58 | 58 | 45 | 200 |
| COMPARATIVE EXAMPLE 2 | 60 | 60 | 60 | 40 | 10 OR LOWER |
| COMPARATIVE EXAMPLE 3 | 60 | 60 | 60 | 40 | 100 |

According to the present invention, the batt fibers of the felts 10, 10*a* contain and are integrally combined with the high-polymer elastic material 50, so that the batt fiber layer is made up. Therefore, the felts 10, 10*a* exhibit an excellent sustained ability to be compressed and recovered based on the pressure resisting effect of the high-polymer elastic material 50 even if the felts 10, 10*a* are repeatedly compressed under the pressure of a press.

As the amount of high-polymer elastic material 50 contained in the felts 10, 10*a* is greater, the felts 10, 10*a* exhibit a more excellent sustained ability to be compressed and recovered.

The batt fiber layer which includes hydrophilic 1-methyl-2-pyrrolidone provides a hydrophilic felt structure. As a result, sufficient water can penetrate the felts 10, 10A from an initial phase of use immediately after the felts 10, 10*a* are installed in the papermaking machine. Therefore, the papermaking machine can operate at a maximum rate from the initial phase of use immediately after the felts 10, 10*a* are installed in the papermaking machine.

The embodiments of the present invention (including modifications and examples) have been described above. The present invention is not limited to the above embodiments, and various changes and additions may be made to the embodiments within the scope of the invention.

Identical reference characters denote identical or corresponding parts throughout views.

INDUSTRIAL APPLICABILITY

The felt for papermaking according to the present invention is applicable to a pressing zone of a papermaking machine.

The invention claimed is:

1. A felt for papermaking comprising a base and a batt fiber layer, wherein said batt fiber layer consists of batt fibers contained in and integrally combined with a high-polymer elastic material, and said batt fiber layer includes 1-methyl-2-pyrrolidone, and wherein said batt fiber layer contained in said high-polymer elastic material includes 5 g/m$^2$ to 100 g/m$^2$ of the 1-methyl-2-pyrrolidone, and wherein said high-polymer elastic material comprises an emulsion resin including one or more of a urethane emulsion, a vinyl acetate emulsion, a styrene-butadiene emulsion and, an acrylic emulsion, so that water penetrates said felts in short periods of time, and said felts have an ability to squeeze water out of a wet paper web and an ability to sustain the ability to squeeze water out of said wet paper web, and said felts are wetted with water quickly.

2. A felt for papermaking according to claim 1, wherein said batt fibers contain 20 g/m$^2$ to 150 g/m$^2$ of the high-polymer elastic material.

3. A felt for papermaking according to claim 1, wherein a surfactant is added to said emulsion resin for stabilizing said emulsion resin.

* * * * *